US005437128A

United States Patent [19]

Gremillion

[11] Patent Number: 5,437,128

[45] Date of Patent: Aug. 1, 1995

[54] GROUND ANCHOR

[75] Inventor: Max K. Gremillion, Canyon Country, Calif.

[73] Assignees: Patrick N. Gremillion; Janice L. Gremillion, both of Carbondale, Calif.

[21] Appl. No.: 8,639

[22] Filed: Jan. 25, 1993

[51] Int. Cl.[6] ..... F02D 5/80

[52] U.S. Cl. ..... 52/162; 52/155; 52/166

[58] Field of Search ..... 52/153, 154, 155, 162, 52/163, 164, 166; 114/294, 301, 304, 309, 310

[56] References Cited

U.S. PATENT DOCUMENTS

| | | | |
|---|---|---|---|
| 1,316,323 | 9/1919 | Poole | 52/155 |
| 2,487,549 | 11/1949 | Hess . | |
| 2,490,423 | 12/1949 | Fearn . | |
| 2,941,636 | 6/1960 | Cordes | 52/164 |
| 2,959,145 | 11/1960 | Galloway . | |
| 3,269,348 | 8/1966 | Churchward . | |
| 3,425,174 | 5/1967 | Wood . | |
| 3,747,552 | 7/1973 | Rhodes . | |
| 3,961,451 | 6/1976 | McCain | 52/163 |
| 3,964,420 | 6/1976 | Stelling . | |
| 4,210,092 | 7/1980 | Battersby . | |
| 4,315,387 | 2/1982 | Lee et al. . | |
| 4,825,604 | 5/1989 | Manning | 52/158 |
| 4,831,952 | 5/1989 | Dulhunty | 114/309 |

*Primary Examiner*—Michael Safavi
*Attorney, Agent, or Firm*—Henry M. Bissell

[57] ABSTRACT

The ground anchor of the invention is used for winching vehicles from mud, river beds, sand embankments and the like and up rough terrain, such as hills and mountains. The anchor includes a blade with a sharp ground-engaging point, a cantilever post preferably releasably connected to the center of the blade, as by post tabs in slots in the blade, and locked in place by a latch arm with a hook. The anchor also includes an elongated tongue pivotally connected to the end of the post which is remote from the blade and which extends in the same direction as the point of the blade. The tongue has at its free end a connector to retain a winch cable. Tension linkage is pivotably connected to the mid portion of the post and to the remote end of the tongue and extends generally in the direction of the point. The anchor includes a support brace in the form of a truncated triangle with cross bar and diverging depending ground-engaging legs. The brace is releasable pivotally connected through the crossbar to the upper surface of the post by a spring clip. The brace serves to hold the blade upright in ground-engagable position. The anchor is compact, relatively light in weight and efficient.

19 Claims, 2 Drawing Sheets

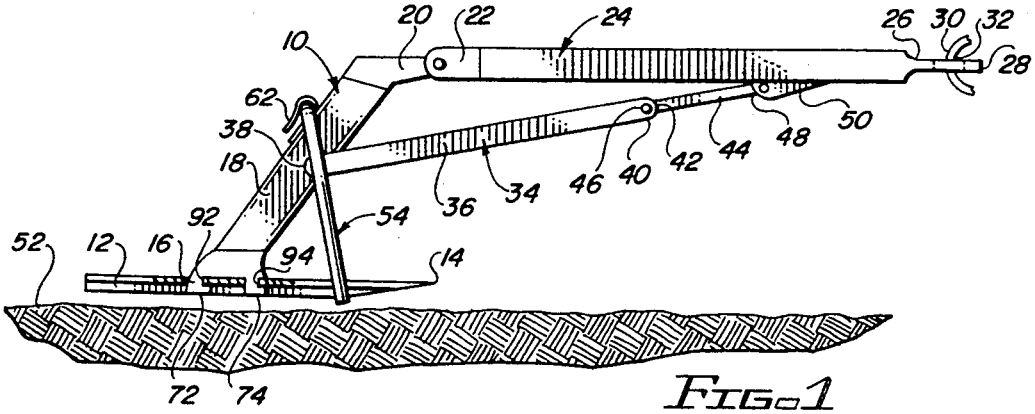
FIG. 1
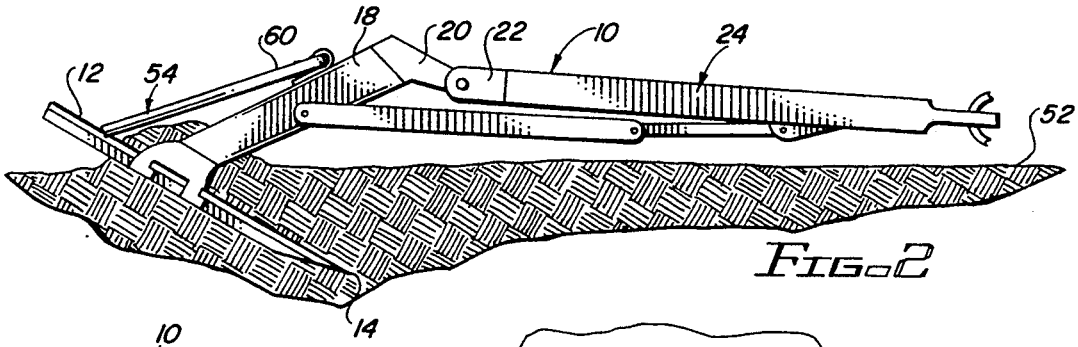
FIG. 2
FIG. 3
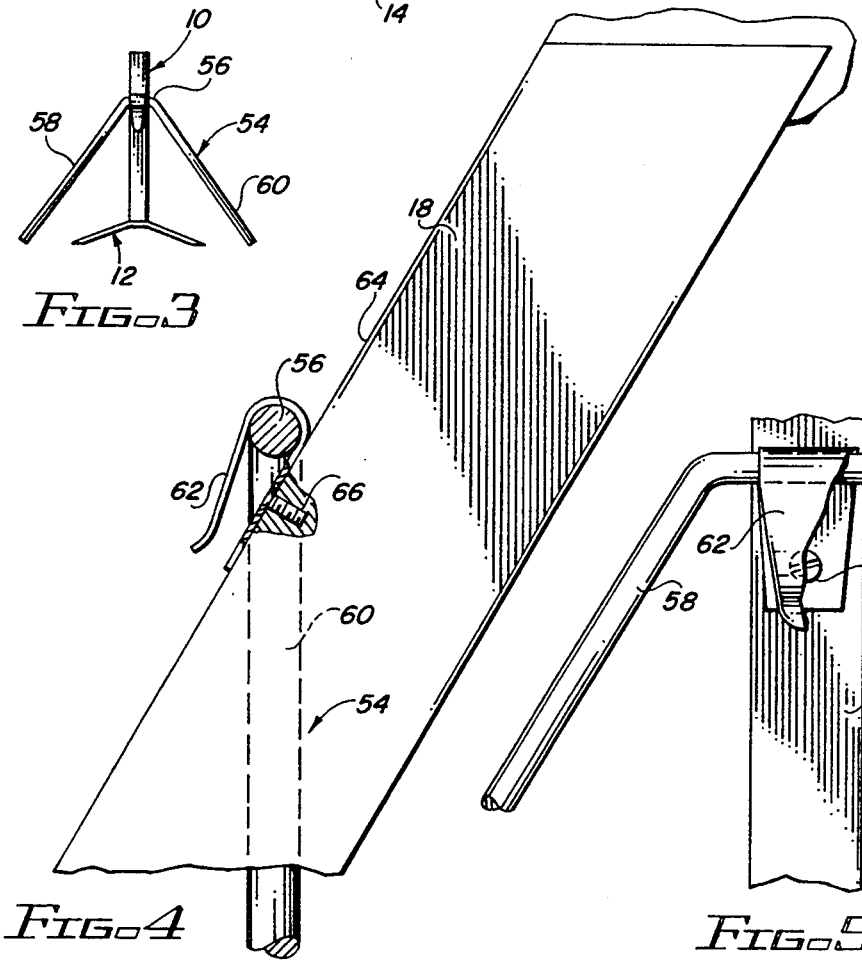
FIG. 4
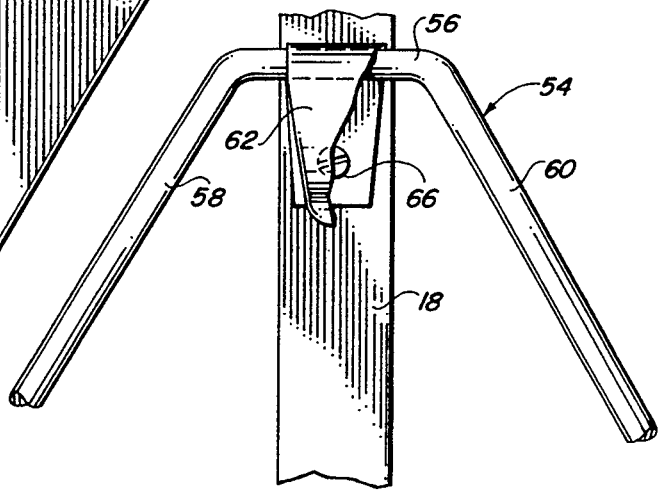
FIG. 5

GROUND ANCHOR

BACKGROUND OF THE INVENTION

1. Field of the Invention

The present invention generally relates to anchoring means and, more particularly, to an improved ground anchor adapted for use with a winch to haul a vehicle from a bogged down position.

2. Description of the Related Art

In the past, vehicles have been drawn from places in which they have become bogged down or buried, by means of power from the bogged down vehicle applied through a winch and cable carried on the vehicle. However, such use of a winch and cable required means, such as a tree, boulder, large pole or other large and fixed anchor means already in place close enough to the vehicle to be used. The cable was then attached to such anchor and the vehicle was winched out of its bogged condition by its own winch. However, there are many wild and remote areas such as swamps, deserts, beaches and the like which do not provide such natural anchor means referred to above and thus such a device could not be used.

U.S. Pat. No. 3,425,174 solved the problem of finding an anchor for the winch cable by disclosing the use of a small portable and efficient anchor which can be deployed for anchoring purposes. The anchor includes a pointed blade connected to a cantilever post and collapsible linkage assembly.

However, the ground anchor disclosed in that patent has certain drawbacks. Thus, it requires that the anchor be guided into and held in place by hand until it takes hold in the ground during the winching operation. This means that the system employing the anchor requires someone at the vehicle operating the winch and another person at the anchor. Accordingly, there remains a need for an improved ground anchor which can automatically position the anchor without human attendance.

SUMMARY OF THE INVENTION

The improved ground anchor of the present invention satisfies all the foregoing needs. The ground anchor is substantially as set forth in the Abstract of the Disclosure. Thus, it comprises a blade with a sharp ground-engaging point the blade is preferably readily locked in place on and readily detachable from a cantilever post which forms part of the anchor. The locking means includes spaced depending tabs on the underside of the post which pass through openings in the blade and are releasably locked in place by a latch arm with hook which is connected to the underside of the blade.

The anchor also includes an elongated tongue extending in the same direction as the point of the blade and pivoted to the free end of the post. The free end of the tongue has a winch cable receptor. Tension linkage is pivotally connected to the mid portion of the post and the free end of the tongue. An important feature of the improved ground anchor is a support brace which holds the point of the blade in the proper ground-engagable attitude without human attendance. The ground brace is in the form of a truncated, inverted V-shape or a truncated triangle (in end view), the upper transverse bar thereof being pivotally connected to the upper surface of the post by a spring clip. Diverging ground-engaging legs depend from opposite ends of the bar. In use, the support brace pivots out of the way as the anchor is set into the ground by tension from the winch.

It is readily removable from the anchor assembly for stowing.

Thus, an improved ground anchor is provided which is light in weight, compact and efficient. Further features of the ground anchor of the present invention are set forth in the following detailed description and accompanying drawings.

BRIEF DESCRIPTION OF THE DRAWING

A better understanding of the present invention may be realized from a consideration of the following detailed description, taken in conjunction with the accompanying drawing in which:

FIG. 1 is a schematic side elevation of a preferred embodiment of the improved ground anchor of the present invention, shown with the support brace thereof engaging the ground and allowing the blade thereof to pivot into ground-engaging position;

FIG. 2 is a schematic side elevation of the ground anchor of FIG. 1 showing the ground anchor with its point dug into the ground and with the support brace folding out of the way for proper winching action;

FIG. 3 is a schematic rear elevation of the ground anchor of FIG. 1;

FIG. 4 is an enlarged fragmentary schematic side elevation, partly broken away, showing the spring clip and brace array of the ground anchor of FIG. 1;

FIG. 5 is an enlarged fragmentary schematic rear elevation, partly broken away, of the spring clip and brace array of the ground anchor of FIG. 1;

DETAILED DESCRIPTION OF THE PREFERRED EMBODIMENTS

Figure 6:
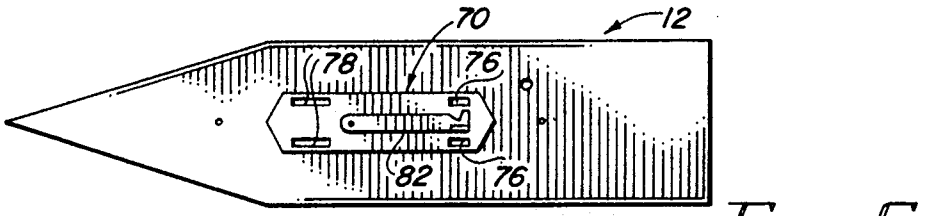
FIG. 6 is an enlarged schematic bottom plan view of the blade-locking means of the ground anchor of FIG. 1.

Now referring more particularly to FIGS. 1–8 of the accompanying drawings, a preferred embodiment of the improved ground anchor of the present invention is schematically depicted therein. Thus, ground anchor 10 is shown which comprises, in combination, an elongated blade 12 having a ground-engaging point 14 at one end thereof, blade 12 being releasable connected at about its midpoint to the lower end 16 of a cantilever post 18 rising thereabove. The free end 20 of post 18 extends in the same general direction as point 14 and is pivotally connected to end 22 of an elongated tongue 24, also extending in the same direction as point 12. The opposite end 26 of tongue 24 bears a connector 28 in the form of a ring or the like for receiving one end 30 of a vehicle winch cable 32.

Anchor 10 also includes tension linkage 34 which comprises a pair of elongated arms 36 pivotally connected at one end 38 thereof to opposite sides of post 28 at about the midpoint thereof. The opposite ends 40 of arms 36 are pivotally connected to one end 42 of a short arm 44 by a cross bar 46. The opposite end 48 of arm 44 is pivotally connected to a pair of depending ears connected to the underside of tongue 24 adjacent end 26 thereof, as shown in FIG. 1. As can be seen by comparing FIGS. 1 and 2, when blade point 14 digs into the ground 52 as cable 32 is drawn in, linkage 34, post 18 and tongue 24 move into a substantially parallel position, essentially perpendicular to blade 12, and blade 12 becomes firmly anchored.

Anchor 10 is also provided with a brace 54 which is generally truncated triangular in end view (FIG. 3) and which comprises a transverse short upper bar 56 and downwardly diverging ground-contacting legs 58 and 60. Brace 54 is releasably and pivotally secured by an open-ended spring clip 62 to the upper surface 64 of post 18. Clip 62 is in turn anchored to surface 64 by a threaded screw 66. Thus, brace can be removed from post 18 and is free to swing therearound. Legs 58 and 60 support blade 12 in a position (FIG. 1) which enables it to freely move into the ground-digging position (FIG. 2) as winch cable 32 is drawn tight and wound up. When blade 12 has moved into the position shown in FIG. 2, legs 58 and 60 automatically are pivoted out of the way. In any event, before winching up begins, legs 58 and 60 automatically support blade 12 so it can be used without human hand guidance.

Figure 7:
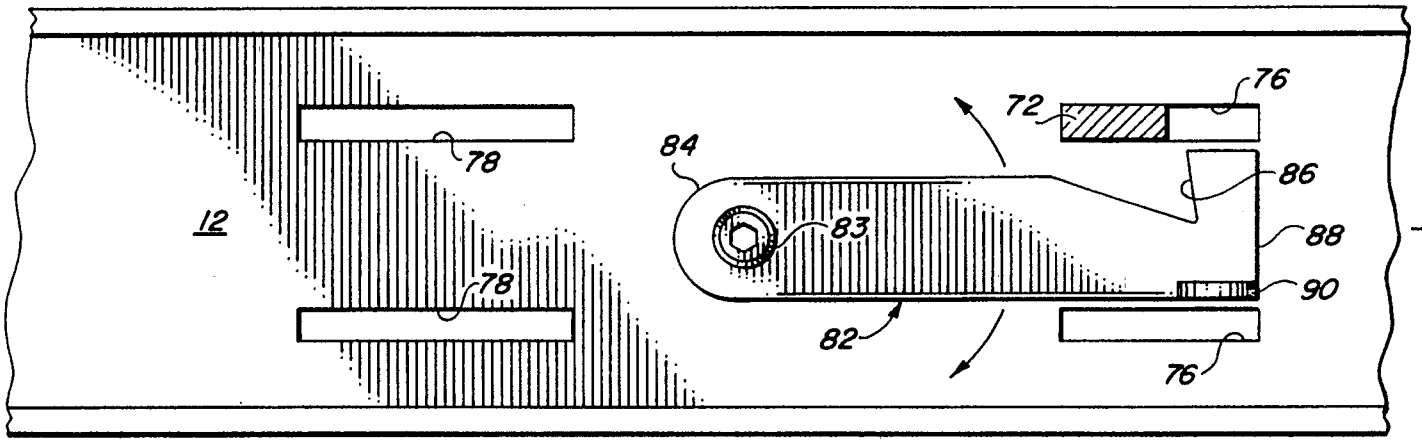
FIG. 7 is a further enlarged fragmentary schematic bottom plan view of the blade-locking portion of FIG. 6.
Figure 8:
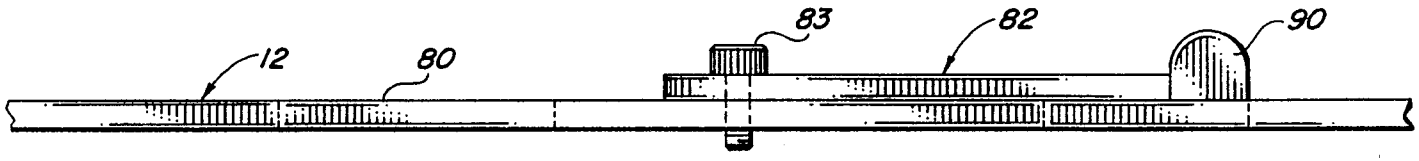
FIG. 8 is a further enlarged fragmentary schematic side elevation, partly broken away, of the blade-locking portion of FIG. 6.

Another feature of anchor 10 is shown in detail in FIGS. 6–8. Thus, releasable blade lock 70 is shown therein. It includes a spaced parallel pair of rear tabs 72 and a spaced parallel pair of front tabs 74 depending from lower end 16 of post 18 (FIG. 1). Only a single tab 72 is shown in FIG. 7. Tabs 72 and 74 (see FIG. 1) fit into two pairs 76 and 78, respectively, of mating slots extending down through the central portion of blade 12. The underside 80 of blade 12 is also provided with a latch arm 82 pivotally connected by machine bolt 83 to underside 80 at one end 84 of arm 82 and bearing a hook 86 at the opposite free end 88 of arm 82. Tabs 72 and rear slots 76 are dimensioned along with latch arm 82 and hook 86 such that when hook 86 is urged into a wedging position against one of tabs 72, as by pushing against latch arm ear 90, tabs 72 and 74 are driven into tight engagement with the portions of underside 80 of blade 12 which define the front portions of slots 76 and 78, releasably locking blade 12 to post 18.

In order to facilitate the described locking effect, tabs 72 and 74 can be provided with horizontal tab slots 92 and 94 (FIG. 1) within which are releasably and wedgingly received the aforesaid portions of underside 80 defining the front portions of slots 76 and 78 when urged by latch arm 82. With the described arrangement, blade 12 can be easily mounted on and removed from post 18 for storage, replacement or repair, thus increasing the storageability and utility of ground anchor 10.

It will be understood that anchor 10 and its components can be made of any suitable materials, preferably steel, and of any suitable dimensions. Anchor 10 can be used just with brace 54 and without lock 70 or vice versa. However, the greatest benefits are achieved when both these improvements are utilized in anchor 10.

Although there has been described hereinabove one specific arrangement of an improved ground anchor in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An improved ground anchor comprising, in combination:

a) a blade having a ground-penetrating point;

b) a cantilever post releasably connected to and extending from the approximate center of said blade;

c) an elongated tongue pivotally connected to the end of said post which is remote from said blade and extending in the same direction as said point of said blade, said tongue bearing means on the remote end thereof for connection to a winch cable;

d) tension linkage pivotally connected to a mid portion of said post and pivotally connected to a portion of said tongue adjacent said remote end thereof and extending generally in the same direction as said point, said linkage comprising a plurality of longitudinally extending links pivotally connected together at their adjoining ends; and e) a support brace pivotally connected to said cantilever post and depending therefrom, said brace including a pair of depending support legs adapted to contact the ground and position said blade for engagement with the ground.

2. The improved ground anchor of claim 1 wherein said brace has a generally truncated triangular configuration in end view which includes a top crossbar and said depending legs and is pivotally connected through said crossbar to the upper surface of said cantilever post at about the mid portion thereof.

3. The improved ground anchor of claim 2 wherein said depending legs diverge downwardly and wherein said crossbar is releasably held in a spring clip attached to said mid portion of said upper surface of said cantilever post.

4. The improved ground anchor of claim 1 wherein the underside of said blade includes means for releasably locking said blade to said cantilever post.

5. The improved ground anchor of claim 4 wherein said cantilever post has a lower end and an upper end and wherein said lower end includes a spaced plurality of depending tabs, wherein said blade includes a spaced plurality of longitudinal slots extending down therethrough into which said tabs extend, and wherein said locking means includes an elongated latch arm pivotally connected to the underside of said blade and pivotable into and out of engagement with at least one of said tabs connecting said blade to said post and gripping said tab, thereby releasably holding said blade against said cantilever post.

6. The improved ground anchor of claim 5 wherein said anchor includes four said tabs and four said slots and wherein said latch arm includes a connector end having a hook which releasably engages one of said four tabs to lock said blade in place against said cantilever post.

7. The improved ground anchor of claim 6 wherein said tabs include longitudinally extending slots which permit said tabs to be wedged forward by said latch into a locked position in which said slots receive the front portions of those areas of said blade which define said slots.

8. In combination with a ground anchor comprising a blade having a ground-penetrating point; a cantilever post extending from the approximate center of said blade; tab and slot means releasably connecting said cantilever post to said blade; an elongated tongue pivotally connected to the end of said post which is remote from said blade and extending in the same direction as said point of said blade with means on the remote end of said tongue for connection to a winch cable; and tension linkage pivotally connected between a mid portion of said post and a portion of said tongue adjacent said remote end thereof;

the improvement comprising:

a support assembly for maintaining the ground anchor upright prior to ground penetration, the assembly including at least one depending support leg and means releasably attaching said support leg to said cantilever post.

9. The improvement of claim 8 wherein the support assembly comprises a support brace pivotally connected to said cantilever post and depending therefrom, said brace including a pair of depending support legs adapted to contact the ground and position said blade for engagement with the ground.

10. The improvement of claim 9 wherein said support brace is shaped in the form of a truncated inverted V-shape having a pair of support legs extending to either side of said cantilever post and said blade.

11. The improvement of claim 10 wherein said releasably attaching means comprises a spring clip affixed to said cantilever post and engaging said support brace in the approximate center of said truncated inverted V-shape.

12. The improvement of claim 8 further including releasable latching means for latching the tab and slot means together.

13. The improvement of claim 12 wherein the end of the cantilever post adjacent the blade terminates in a plurality of spaced-apart tabs and wherein said blade has a set of slots spaced in correspondence with said tabs, each of said tabs having a recess which permits the cantilever post to slide forward along the blade after the tabs are inserted in said slots, and wherein said releasable latching means include a latching member pivotably mounted to the underside of said blade and having hook portion means engaging at least one of said tabs to maintain the tabs in the forward position of said blade slots, thereby preventing disconnection of the blade from the cantilever post.

14. In combination with a ground anchor comprising a blade having a ground-penetrating point; a cantilever post connected to extend from the approximate center of said blade; tab and slot means releasably connecting said cantilever post to said blade; an elongated tongue pivotally connected to the end of said post which is remote from said blade and extending in the same direction as said point of said blade with means on the remote end of said tongue for connection to a winch cable; and tension linkage pivotally connected between a mid portion of said post and a portion of said tongue adjacent said remote end thereof;

the improvement comprising:

pivotable latching means for latching the tab and slot means together.

15. The improvement of claim 14 wherein the end of the cantilever post adjacent the blade terminates in a plurality of spaced-apart tabs; wherein said blade has a set of slots spaced in correspondence with said tabs, each of said tabs having a recess which permits the cantilever post to slide forward along the blade after the tabs are inserted in said slots; and wherein said releasable latching means include a latching member pivotably mounted to the underside of said blade and having hook portion means engaging at least one of said tabs to maintain the tabs in the forward position of said blade slots, thereby preventing disconnection of the blade from the cantilever post.

16. The improvement of claim 15 further including a support assembly for maintaining the ground anchor upright prior to ground penetration, the assembly including at least one depending support leg and means for releasably attaching said support leg to said cantilever post.

17. The improvement of claim 16 wherein the support assembly comprises a support brace pivotally connected to said cantilever post and depending therefrom, said brace including a pair of depending support legs adapted to contact the ground and position said blade for engagement with the ground.

18. The improvement of claim 17 wherein said support brace is shaped in the form of a truncated inverted V-shape having a pair of support legs extending to either side of said cantilever post and said blade.

19. The improvement of claim 18 wherein said releasably attaching means comprises a spring clip affixed to said cantilever post and engaging said support brace in the approximate center of said truncated inverted V-shape.

* * * * *